US011221117B1

(12) United States Patent
Xu

(10) Patent No.: US 11,221,117 B1
(45) Date of Patent: Jan. 11, 2022

(54) PROJECTION APPARATUS ILLUMINATING WITH CLOUD EFFECT

(71) Applicant: Longcai Xu, Guangzhou (CN)

(72) Inventor: Longcai Xu, Guangzhou (CN)

( * ) Notice: Subject to any disclaimer, the term of this patent is extended or adjusted under 35 U.S.C. 154(b) by 0 days.

(21) Appl. No.: 17/386,784

(22) Filed: Jul. 28, 2021

Related U.S. Application Data

(63) Continuation of application No. 17/334,266, filed on May 28, 2021.

(30) Foreign Application Priority Data

| | | |
|---|---|---|
| Feb. 3, 2021 | (CN) | 202120323204.4 |
| Feb. 3, 2021 | (CN) | 202120325394.3 |
| Feb. 3, 2021 | (CN) | 202120325395.8 |
| Feb. 3, 2021 | (CN) | 202120325517.3 |

(51) Int. Cl.

| | |
|---|---|
| ***F21S 10/06*** | (2006.01) |
| ***F21V 5/04*** | (2006.01) |
| ***F21V 7/04*** | (2006.01) |
| ***F21V 7/10*** | (2006.01) |
| ***F21V 3/02*** | (2006.01) |

(52) U.S. Cl.
CPC ..... *F21S 10/063* (2013.01); *F21V 3/02* (2013.01); *F21V 5/04* (2013.01); *F21V 7/045* (2013.01); *F21V 7/10* (2013.01)

(58) Field of Classification Search
CPC . F21V 33/0004; F21V 3/049; F21W 2121/00; F21W 2121/006; F21W 2121/008
See application file for complete search history.

(56) References Cited

U.S. PATENT DOCUMENTS

| | | | | |
|---|---|---|---|---|
| 4,847,739 | A * | 7/1989 | Saraceni | F21S 10/02 362/232 |
| 9,587,806 | B2 * | 3/2017 | Liu | F21V 21/0832 |
| 11,092,301 | B2 * | 8/2021 | Zheng | F21V 5/04 |
| 2007/0012154 | A1 * | 1/2007 | Tsai | B44C 5/005 84/95.1 |
| 2015/0184844 | A1 * | 7/2015 | Zhang | F21V 13/02 362/96 |
| 2017/0102130 | A1 * | 4/2017 | Hu | F21S 10/063 |

* cited by examiner

*Primary Examiner* — Matthew J. Peerce
(74) *Attorney, Agent, or Firm* — US—China Intellectual Property Counsel, LLC

(57) ABSTRACT

A projection apparatus comprises a housing with a projection opening, a light source component, a reflective bowl and a driving motor in the housing, and a transparent cover is mounted on the housing and protrudes upwardly out of the projection opening. The light emitted by the light source component is illuminated on the reflective surface, and then the light passes through the transparent cover after being reflected. The light source component, the reflective bowl and the transparent cover can project to produce a cloud effect.

12 Claims, 16 Drawing Sheets

PROJECTION APPARATUS ILLUMINATING WITH CLOUD EFFECT

RELATED APPLICATIONS

This application is the continuation application to U.S. patent application Ser. No. 17/334,266, filed on May 28, 2021, claiming priority to CN202120325517.3, CN202120323204.4, CN202120325394.3 and CN202120325395.8, which are all filed on Feb. 3, 2021, the disclosures of which are incorporated herein by reference in their entirety.

FIELD OF INVENTION

The disclosure relates generally to the technical field of projection lamps. The disclosure relates specifically to a projection apparatus illuminating with cloud effect.

BACKGROUND OF THE INVENTION

Projection lamps that create ambient light are generally used in theaters, studios, bars, discos, and other venues that required effects for entertainment purposes. With the growing demand for home entertainment or creating specific projections of ambient light, the portable, compact, energy-saving, and multi-functional ambient projection lamp, that also functions as a decorative lamp, is more popular today. Ambient projection lamps can produce projecting effects, such as a starry galaxy, water ripples, cheerful and festive or warm and romantic ambience, adding vibrant qualities to life.

Among the ambient projection lamps, film type ambient projection lamps can print patterns, and light effect type ambient projection lamps utilize dynamic changes of light. In general, the common light effect type ambient projection lamps can achieve the light effects of cloud, water ripple or flame. This kind of light effect type projection lamp does not need the projection film printed in advance, and can be achieved by the refraction, interference or refocusing of light.

The prior art has suggested several methods to create specific projections of ambient light. U.S. Pat. No. 8,057,045, Randy E. Johnson, Nov. 15, 2011, Star Field Projection Apparatus, discloses a projection method and apparatus for achieving the effect of dynamic starry sky and clouds. CN. Pat. App. No. 107859962A, Yang ruishi, Mar. 30, 2018, discloses a projection lamp that simulates the sky effect. CN. Pat. No. 207796894U, Xu faqing et al., Aug. 31, 2018, discloses a technical solution that uses two pieces of water ripple glass to achieve the projected water ripple effect. CN. Pat. No. 210891354U, Ji Shaoqi, Jun. 30, 2020, discloses a three-in-one galaxy-style lamp structure that uses water ripple sheets and a crystal lid to achieve a nebula effect.

To achieve projected cloud or water ripple effects, all the aforementioned prior arts use a frosted glass or water ripple sheet and other sheet structures with light transmission and refraction (also called interferential wheel) to achieve irregular refractions along the path of the light. Along the projected path of the light is the projection light source, frosted glass or water ripple sheet, convex lens or crystal cover, and then the projection surface. As for the internal components, a frosted glass or water ripple sheet is usually a square or round sheet, and the internal structural components are kept at a certain distance from each other in a primarily open structure. The light from the projection light source leaks light in the interior. If the housing around the projection is thin or lightly colored, or there are gaps due to a loose-fitting assembly, light will leak out of the device, marring the user experience and efficiency of the light source, undermining its energy saving and environmental protection capabilities.

SUMMARY OF THE INVENTION

Considering the defects of prior art, this invention seeks to provide a projected apparatus that illuminates a cloud effect that can realize dynamic changes. The projected apparatus can improve the light utilization rate of the light source to a greater extent, effectively reduce or avoid light leaking from the projection source to enhance user experience.

In one aspect, the invention is directed to a projection apparatus, the projection apparatus comprises a housing includes a projection opening; a light source component, a reflective bowl and a driving motor are all accommodated in the housing, and a transparent cover is mounted on the housing and protrudes upwardly out of the projection opening; wherein the reflective bowl is located between the transparent cover and the light source component, the reflective bowl is provided with a through opening and a reflective surface enclosed on the outer edge of the opening; the light emitted by the light source component is illuminated on the reflective surface, and then the light passes through the transparent cover after being reflected; the driving motor drives the reflective bowl to rotate, and the light source component, the reflective bowl and the transparent cover can project to produce a rotating cloud effect.

In one embodiment, the projection apparatus comprises a reflective bowl base seat and a reflective bowl limit ring, and the reflective bowl base seat is fixed on the housing, wherein the reflective bowl base seat is matched with the reflective bowl limit ring and forms a limit slot, the limit slot is used to receive the limit portion arranged on the reflective bowl to limit the movement of the reflective bowl up and down.

In one embodiment, the reflective bowl base seat is provided with at least one ball groove and at least one ball receiving in the ball groove, and the limit portion is movably matched with the ball.

The reflective bowl comprises an external ring gear and the limit portion, the external ring gear is meshed with a driving gear mounted on a rotor shaft of the driving motor.

The reflective surface is arranged as a diffusing reflective surface, and the diffusing reflective surface is formed by protrusions or indentations, or a wrinkled texture or uneven surface.

The light source component comprises a non-coherent light source and a light conductor sheathed outside the non-coherent light source, the light conductor protrudes into the opening, and the light source component is electrically connected to a control circuit board.

In one embodiment, the light conductor comprises a fixing portion, a light guide portion formed by extending upward from the fixing portion, and a receiving cavity formed by concave upward from the bottom surface of the fixing portion, the light guide portion is protrudes into the through opening of the reflective bowl, the non-coherent light source is housed in the receiving cavity, and the top surface of the light guide portion is provided with a inclined plane structure formed by downward concave extension.

The transparent cover is a hemispherical structure, with a light refracting surface made of polygonal-cut surfaces stitched together on the inner surface of the transparent cover and a smooth, spherical surface on the outer surface of the transparent cover.

In another aspect, the projection apparatus comprises a housing with a projection opening, a light source component, a reflective bowl and a driving motor in the housing, and a transparent cover is mounted on the housing and protrudes upwardly out of the projection opening; the reflective bowl is located between the transparent cover and the light source component, the reflective bowl is provided with a through opening and a reflective surface enclosed on the outer edge of the opening, the light emitted by the light source component is illuminated on the reflective surface, and then the light passes through the transparent cover after being reflected, the driving motor drives the transparent cover to rotate, and the light source component, the reflective bowl and the transparent cover can project to produce a rotating cloud effect.

The projection apparatus comprises an annular rotating seat connected to the housing, wherein the transparent cover is fixed on the annular rotating seat, and the driving gear on the driving motor engages with an outer gear arranged on the annular rotating seat.

The annular rotating seat includes a first rotary seat and a second rotary seat, the first rotary seat has an outer gear which engages the driving gear mounted to the rotor shaft of the driving motor, the first rotary seat is connected to and can also be released from the second rotary seat. The second rotary seat is provided with a protruding holding ring at the outer peripheral edge. The holding ring has a certain gap with the upper outer edge of the first rotary seat. The gap as a whole forms an annular groove. The transparent cover is connected to and can also be released from the second rotary seat. The driving motor drives the transparent cover to rotate through the gearing of the annular rotating seat.

In yet another aspect, the projection apparatus comprises a housing with a projection opening, a light source component, a reflective bowl and a driving motor in the housing, and a transparent cover is mounted on the housing and protrudes upwardly out of the projection opening; wherein the light source component is located between the transparent cover and the reflective bowl, the reflective bowl comprises an reflective surface, the light emitted by the light source component is illuminated on the reflective surface, and then the light passes through the transparent cover after being reflected, the driving motor drives the reflective bowl to rotate, and the light source component, the reflective bowl and the transparent cover can project to produce a rotating cloud effect.

In one embodiment, the light source component further comprises an annular lamp holder and at least one non-coherent light source fixed on the annular lamp holder. The annular lamp holder comprises a positioning portion and an extension portion formed from the positioning portion towards the direction near the central axis of the annular lamp holder and extending upward in an inclined direction. The non-coherent light source is fixed on the inner surface of the extension portion, and the light emitted by the non-coherent light source is illuminated on the reflective surface.

The non-coherent light source is provided with a plurality of non-coherent light sources arranged around the reflective bowl.

The projection apparatus further comprises a reflective bowl base seat fixed to the housing, the reflective bowl base seat is matched with the positioning portion to form a limit slot, and the reflective bowl is provided with a limit portion housed in the limit slot.

Furthermore, the reflective bowl seat is provided with at least one ball groove and at least one ball received in the ball groove, and the limit portion is movably matched with the ball.

The reflective bowl includes an external ring gear formed by a downward extension, which is engaged with a driving gear mounted on a rotor shaft of the driving motor.

In yet another aspect, the projection apparatus comprises a housing which has an accommodation space and a projection opening connected with the accommodation space, a light source component, a reflective bowl and a driving motor are all accommodated in the accommodation space, and a transparent cover is mounted on the housing and protrudes upwardly out of the projection opening; wherein the light source component is located between the transparent cover and the reflective bowl, the reflective bowl comprises an reflective surface, the light emitted by the light source component is illuminated on the reflective surface, then passes through the transparent cover after being reflected, the driving motor drives the transparent cover to rotate, and the light source component, the reflective bowl and the transparent cover can project to produce a rotating cloud effect.

Furthermore, the light source component further comprises an annular lamp holder and at least one non-coherent light source fixed on the annular lamp holder, the annular lamp holder comprises a positioning portion and an extension portion formed from the positioning portion towards the direction near the central axis of the annular lamp holder and extending upward in an inclined direction, the non-coherent light source is fixed on the inner surface of the extension portion, and the light emitted by the non-coherent light source is illuminated on the reflective surface.

In addition, the projection apparatus comprises an annular rotating seat connected to the housing, wherein the transparent cover is fixed on the annular rotating seat, and the driving gear on the driving motor engages with an outer gear arranged on the annular rotating seat.

Furthermore, the light source component further comprises an annular lamp holder and at least one non-coherent light source fixed on the annular lamp holder. The annular lamp holder extends downward to form a plurality of buckle portions, and the buckle portion is fastened with the limit portion of the reflective bowl.

The reflective surface of the reflective bowl is arranged as a diffusing reflecting surface, which is formed by protrusions or indentations, or a wrinkled texture or uneven surface.

In some embodiments, the projection apparatus also has a second projection component that includes a second light source and a diffractive element set in the optical path of the second light source. The second light emitted by the second light source is projected onto a surface through the diffractive element to present an effect that has starlight spots. The second light source is coherent, and a laser can be used to provide a projection light source for the second projection component.

The projection apparatus has the following beneficial effects: 1). A rotating reflective bowl with diffusing reflective surface is arranged on the optical path of the light source component. The light emitted from the non-coherent light source is reflected into the transparent cover by the reflective bowl, and then projected onto a surface to achieve a rotating cloud effect, thus creating a beautiful and magnificent cloud effect for the interior. 2). The projection apparatus also has a second projection component. To enhance the projected cloud effect, the laser projects light effect onto a surface through the diffractive element to create starlight spots and a better ambience by combining with the rotating cloud effect. 3) The invention has creatively adopted a rotating reflective bowl structure, which can effectively reduce or avoid light leaking internally, and at the same time, effectively improve light utilization rate for the projection light source, which saves energy and is more environmental-friendly.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

Figure 1:
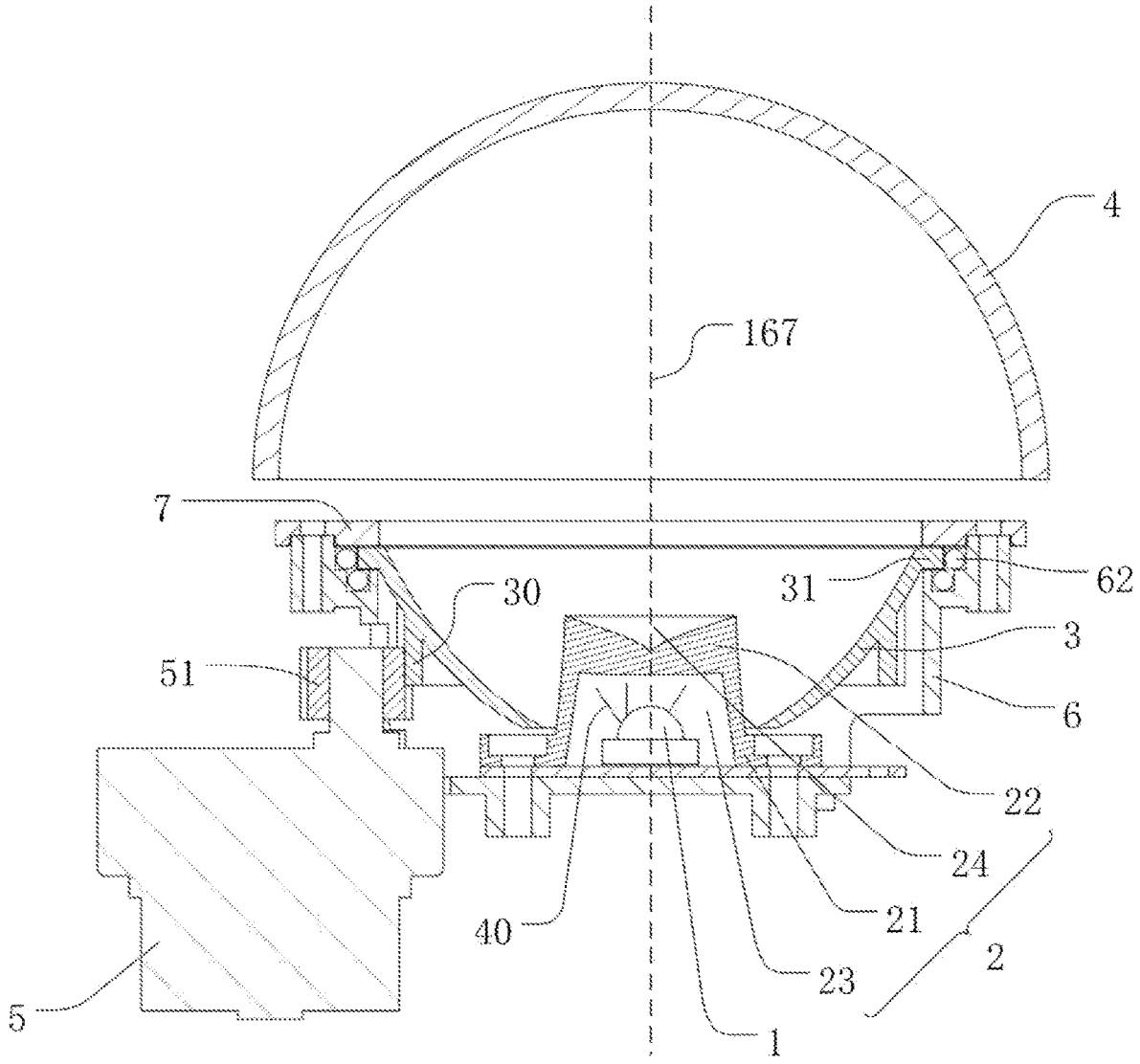
FIG. 1 is a cross-sectional view of the first projection component of the first embodiment of the present invention.
Figure 2:
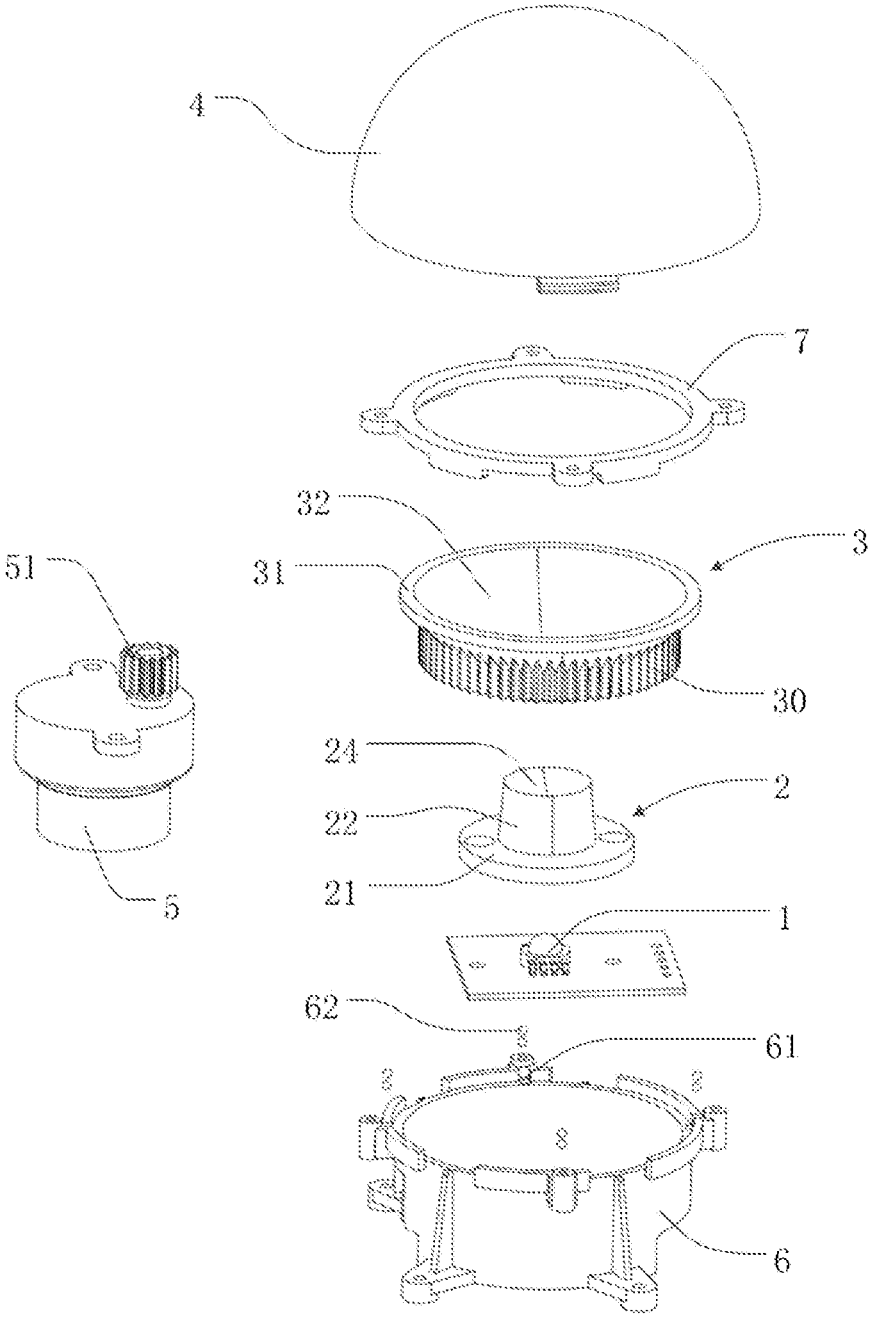
FIG. 2 is an exploded view of the first projection component of the first embodiment.

The particulars shown herein are by way of example and for purposes of illustrative discussion of four embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

As used herein, if the connection or fixing modes between the structural parts are not specifically described, the connection or fixing modes can be the bolts, dowels, slide fasteners, or snap fasteners commonly used in the prior art, or welding or adhesive fixings, or rotating shaft connection, etc. Therefore, they are not described in detail in this embodiment.

FIGS. 1-4 illustrate the first embodiment of the present invention. A projection apparatus comprises a first projection component, which has a first light source 1, a light conductor 2 placed upon the first light source 1, a rotating reflective bowl 3 with a through opening 126 at the bottom thereof and a transparent cover 4 set with a light refracting surface 127. The first light source 1 and the light conductor 2 form a light source component 123. The transparent cover 4 is located above the reflective bowl 3, such that the reflective bowl 3 is located between the transparent cover 4 and the light source component 123. The first light 40 emitted from the first light source 1 is directed by the light conductor 2 to illuminate the reflective bowl 3 and is reflected and then projected through the transparent cover 4 onto a surface to present a cloud effect. The light source component 123 is electrically connected to a control circuit board 8.

The projection apparatus further comprises a driving motor 5 which connects with the gears on the reflective bowl 3. The rotation of the reflective bowl 3 is controlled by the driving motor 5, and the light 40 emitted by the first light source 1 illuminates the reflective bowl 3, guided by the light conductor 2, and the light is reflected and then transmitted through the transparent cover 4, until it is finally projected onto a surface to present a rotating cloud effect.

Furthermore, the reflective bowl 3 comprises an external ring gear 30 and a limit portion 31. The external ring gear 30 is engaged with a driving gear 51 mounted on a rotor shaft of the driving motor 5.

The reflective bowl 3 has a reflective surface 32, which is arranged as a diffusing reflective surface, and the diffusing reflective surface is formed by protrusions or indentations, or a wrinkled texture or uneven surface.

Referring back to FIGS. 1-2, preferably, to result in the reflective bowl 3's quiet and stable rotating motion driven by motor 5, the projection apparatus is provided with a reflective bowl base seat 6, a ball set 62 and a reflective bowl limit ring 7. The ball set 62 is provided with four groups of ball, which are symmetrically placed in the 4 groups of ball grooves 61 on the circular edge of the reflective bowl base seat 6. The ball grooves 61 are respectively placed in the four equal diversion points on the circular edge of the reflective bowl base seat 6. The reflective bowl 3 is placed on the reflective bowl base seat 6, which forms a support for the reflective bowl 3. The ball set 62 is movably matched with the limit portion 31 to reduce friction between the reflective bowl 3 and the reflective bowl base seat 6 when rotating, which will improve the efficiency of rotating motion. The reflective bowl limit ring 7 is mounted on the upper edge of the reflective bowl base seat 6, forming a limit cover above the reflective bowl 3 and the ball set 62, and thus preventing the reflective bowl 3 and the ball set 62 from disengaging upwards.

The light conductor 2 protrudes into the through opening 126 at the bottom of the reflective bowl 3, and the first light source 1 is electrically connected to a control circuit board 8. The light conductor 2 includes a fixing portion 21, a light guide portion 22 formed by extending upward from the fixing portion 21 and a receiving cavity 23 formed by concave upward from the bottom surface of the fixing portion 21. The light guide portion 22 is convexly extended into the through opening 126, the first light source 1 is housed in the receiving cavity 23, and the top surface of the light guide portion 22 is provided with an inclined plane structure 24 formed by downward concave extension. The light guide portion 22 is used to guide the light 40 of the first light source 1 to illuminate the reflective bowl 3 on the outer circumference of the light conductor 2 uniformly.

The transparent cover 4 is a hemispherical structure, with a light refracting surface 127 made of polygonal cut surfaces stitched together on the inner surface of the transparent cover 4, and a smooth spherical surface 128 on the outer surface of the transparent cover 4.

Figure 3:
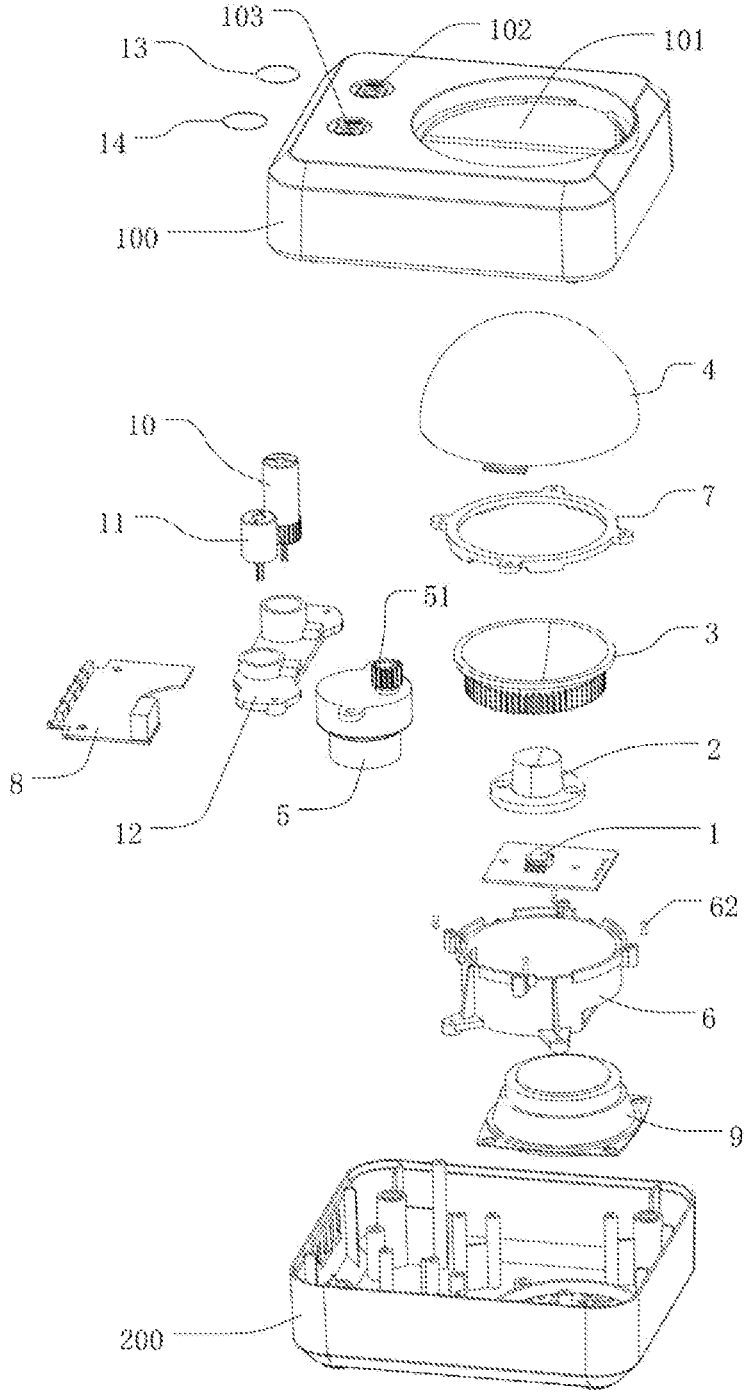
FIG. 3 is an exploded view of the overall structure of the projection apparatus of the first embodiment.

Referring to FIG. 3, in some embodiments, the projection apparatus preferably comprises a second projection component which includes a second light source 10 and a second light source diffractive element 13 placed in the optical path of the second light source 10. The second light emitted by the second light source 10 is projected onto a surface through the diffractive element 13 of the second light source 10 to present an effect of starlight spots.

The projection apparatus further comprises a third projection component which has a third light source 11 and a third light source diffractive element 14 placed in the optical path of the third light source 11. The light emitted by the third light source 11 is projected onto a surface through the diffractive element 14 of the third light source 11 to present a fixed projection pattern effect.

The first light source 1 is a non-coherent light source, and conventional full-color LED can be used to provide a projection light source for the first projection component. The second light source 10 is a coherent light source, and a laser can be used to provide a projection light source for the second projection component. The third light source 11 is also a coherent light source, and a laser can be used to provide a projection light source for the third projection component.

Furthermore, the center points of the first light source 1, the light conductor 2, the reflective bowl 3 and the transparent cover 4 are all located on a straight line of the same projection light axis 167.

The projection apparatus further comprises a control circuit board 8, which include a driving motor control unit (not shown), a light source control unit (not shown), and a power supply management unit (not shown). The driving motor control unit is used for turning on or turning off or adjusting the speed of the driving motor 5. The light source control unit controls the first light source 1 to be constantly on or off or changing colors or circularly changing by gradually brightening and extinguishing, and/or controlling the second light source 10 to be constantly on or off or circularly changing by gradually brightening and extinguishing, and/or controlling the third light source 11 to be constantly on or off or circularly changing by gradually brightening and extinguishing. The power supply management unit supplies power to the projection apparatus through an external power supply or a built-in rechargeable battery through a power interface.

The control circuit board 8 further comprises a Bluetooth connection unit (not shown), an audio processing unit (not shown), an infrared remote-control unit (not shown), and a plurality of control buttons (not shown). The Bluetooth connection unit is used for connecting Bluetooth-enabled peripheral devices. The audio processing unit processes digital audio signals, so that the cloud projection apparatus can play music to create a better ambience with the projection light effects. The infrared remote-control unit receives remote control signals sent by an infrared remote control of an external device.

Furthermore, the first light source 1, the second light source 10, the third light source 11, the driving motor 5 and a speaker 9 are electrically connected to the control circuit board 8.

Figure 4:
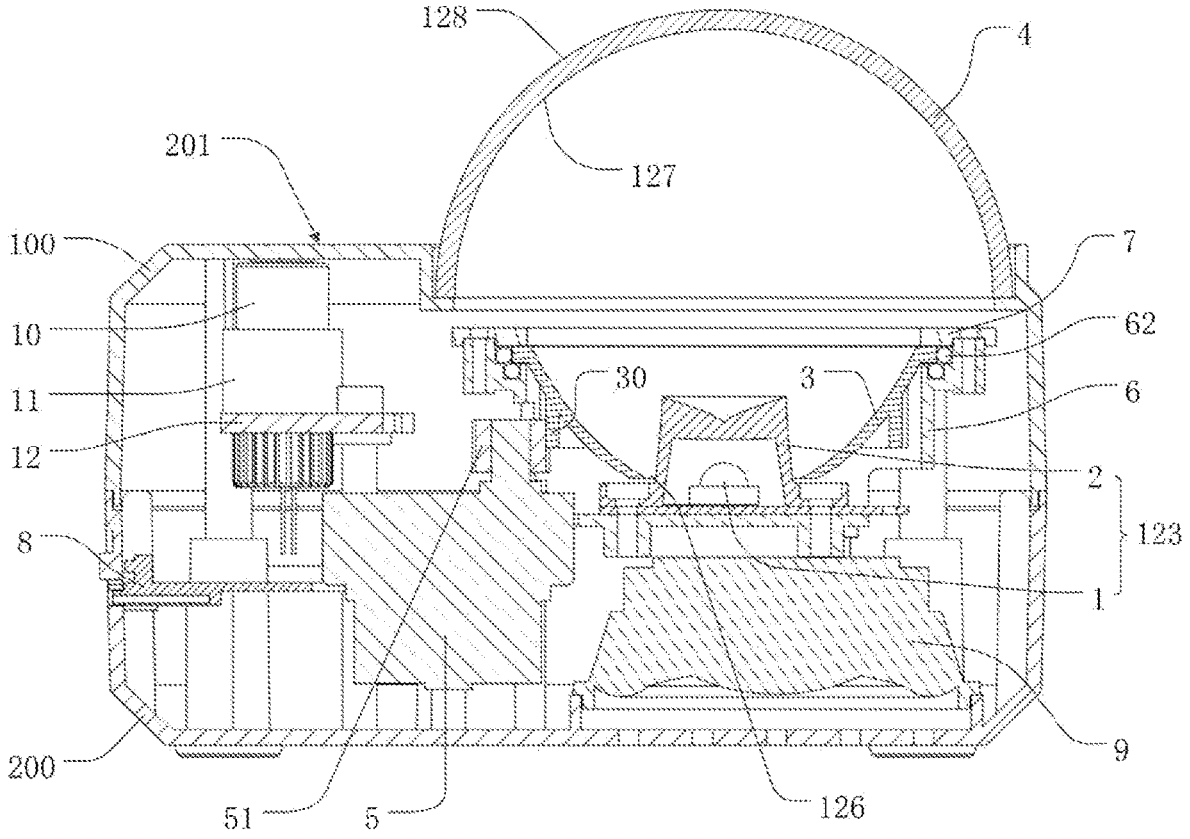
FIG. 4 is a schematic sectional view of the overall structure of the projection apparatus of the first embodiment.
Figure 5:
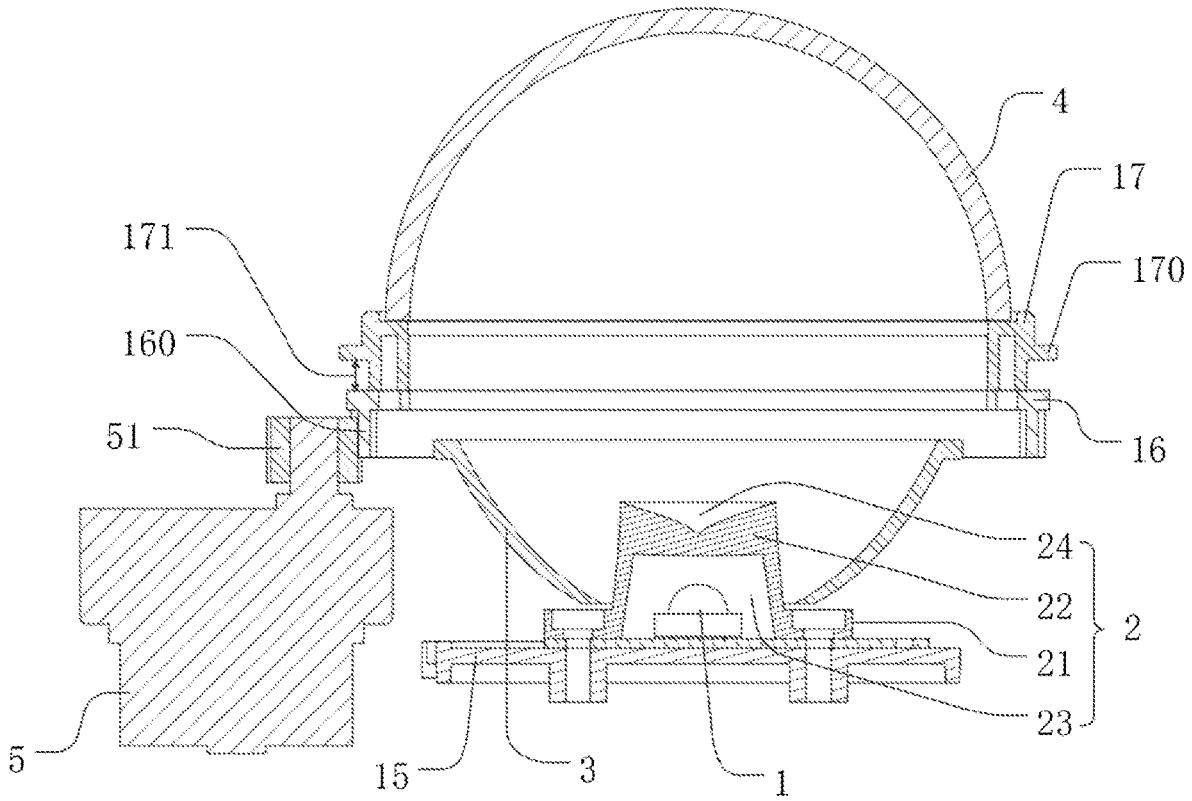
FIG. 5 is a cross-sectional view of the first projection component of the second embodiment of the present invention.

Referring to FIGS. 3-4, the projection apparatus further comprises a speaker 9 which can play music to match the ambience. The speaker 9 is fixed on the second housing 200.

In some embodiments, the projection apparatus may be operated in a variety of modes, each of which is a free combination of the first light source 1, second light source 10, third light source 11 and control states of the driving motor 5. Different projection combinations can be achieved by switching the control circuit board 8.

In addition, the projection apparatus comprises a first housing 100 section, a second housing section 200 to form a housing 201, and a fixed support 12. The first housing section 100 is provided with a first projection opening 101, a second projection opening 102 and a third projection opening 103. The transparent cover 4 is mounted on the first projection opening 101. The second light source diffractive element 13 is mounted on the second projection opening 102, and the third light source diffractive element 14 is mounted on the third projection opening 103. The second housing section 200 includes an interface hole, a plurality of holes for buttons, and a plurality of sound outlet holes. The fixed support 12 is connected to the second housing section 200. The second light source 10 and the third light source 11 are mounted on the fixed support 12.

FIGS. 5-8 show a second embodiment of the present invention. The second embodiment of the projection apparatus is distinguished from the first embodiment by the following characteristics.

The first projection component of the second embodiment comprises an annular rotating seat connected to the housing section 100, wherein the transparent cover 4 is fixed on the annular rotating seat, and the driving gear 51 on the driving motor 5 engages with an outer gear 160 arranged on the annular rotating seat. The driving motor 5 drives the transparent cover 4 to rotate through driving the annular rotating seat.

Figure 6:
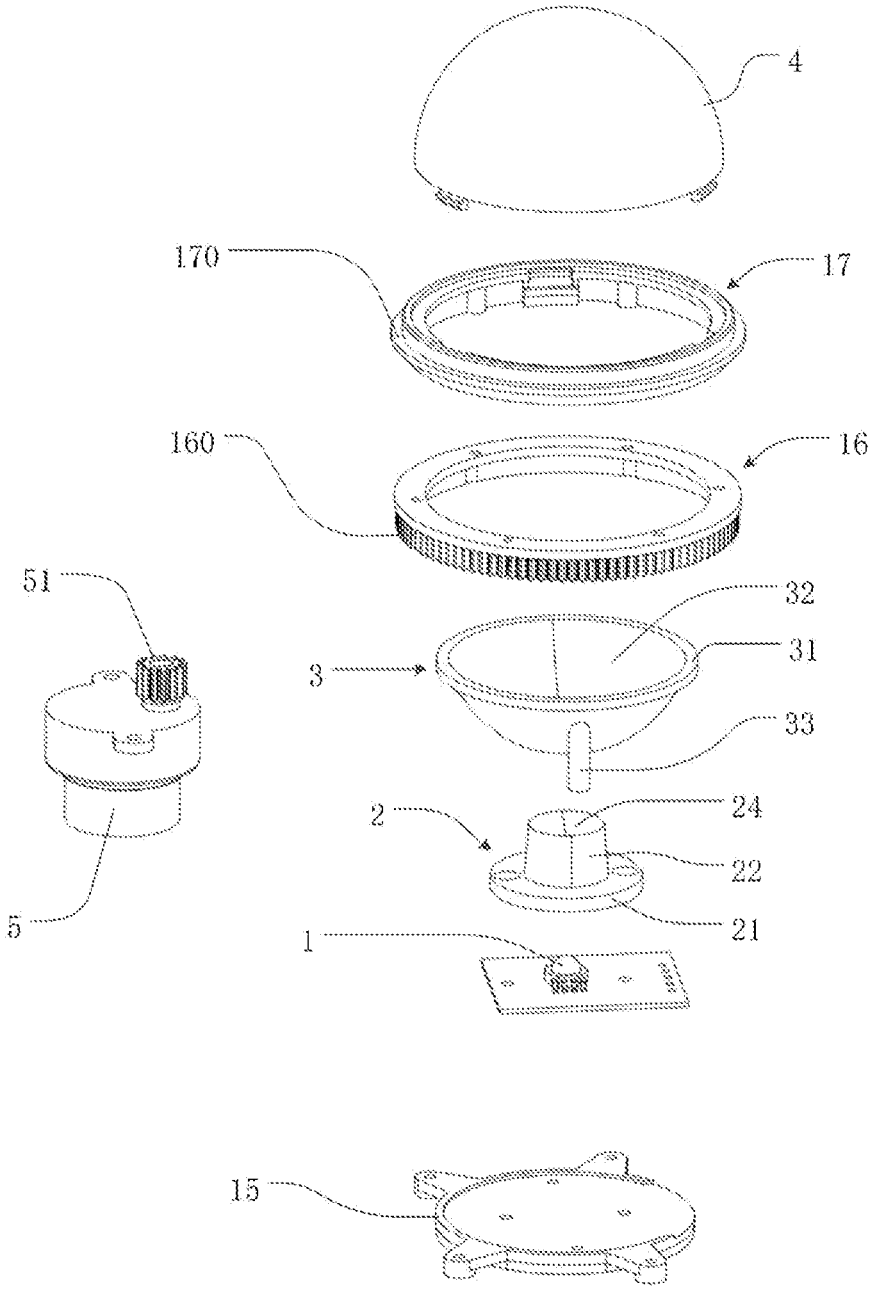
FIG. 6 is an exploded view of the first projection component of the second embodiment.

Referring to FIG. 6, the annular rotating seat includes a first rotary seat 16 and a second rotary seat 17. The first rotary seat 16 has an outer gear 160 which engages the driving gear 51 mounted on the rotor shaft of the driving motor 5. The first rotary seat 16 is connected to and can be released from the second rotary seat 17. The second rotary seat 17 is provided with a protruding holding ring 170 at the outer peripheral edge. The holding ring 170 has a gap which can engage with the upper outer edge of the first rotary seat 16. The gap forms an annular groove 171. The transparent cover 4 is connected to the protruding holding ring 170 and can also be released from the second rotary seat 17.

The first projection component of the second embodiment has neither reflective bowl base seat 6 nor reflective bowl limit ring 7 in the first embodiment, but instead provided with a first projection component base seat 15. The reflective bowl 3 is no longer provided with an external ring gear 30, but instead is provided with a fixed column 33. The first projection component base seat 15 is fixed on the second housing section 200. The first light source 1, light conductor 2 and reflective bowl 3 are fixedly connected with the first projection component base seat 15.

Figure 7:
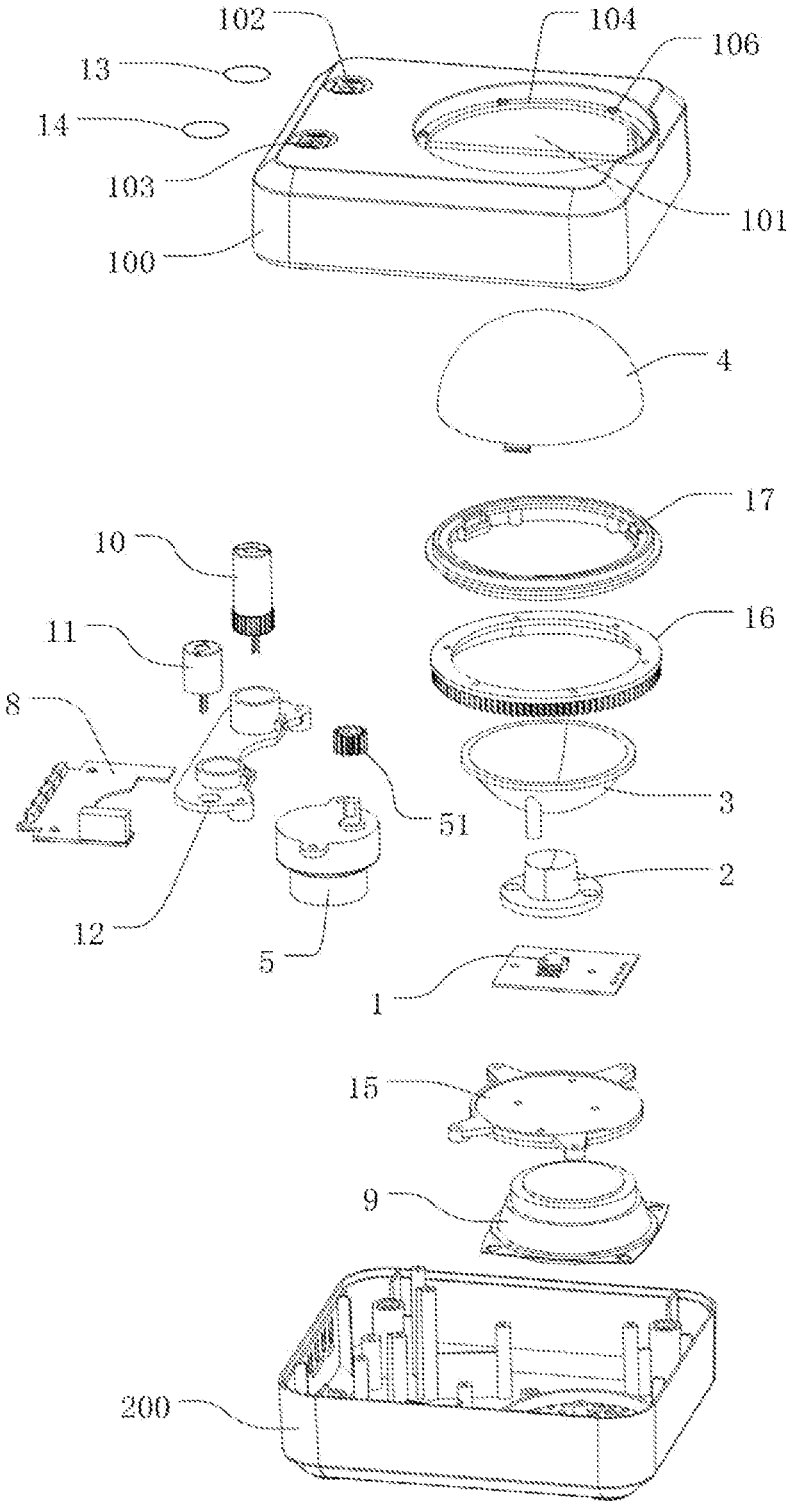
FIG. 7 is an exploded view of the overall structure of the projection apparatus of the second embodiment.
Figure 8:
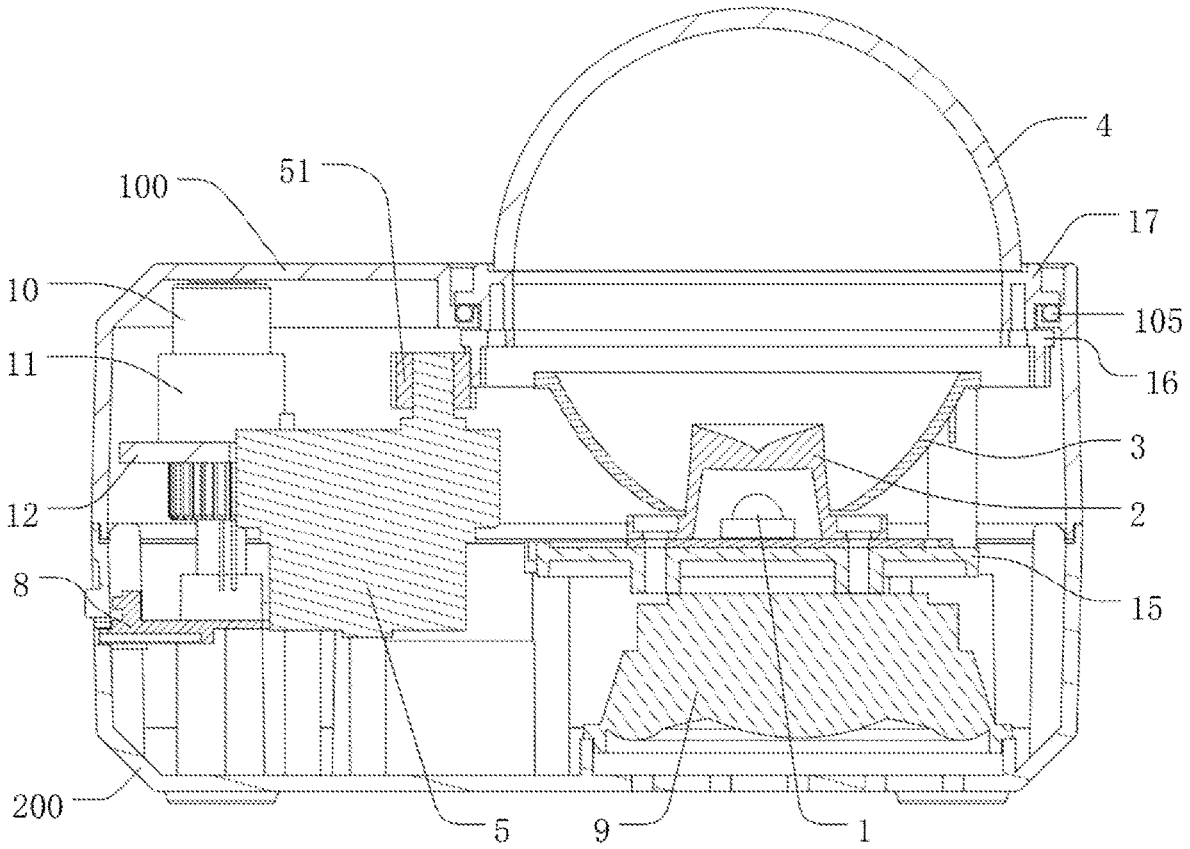
FIG. 8 is a schematic sectional view of the overall structure of the projection apparatus of the second embodiment.

Referring to FIG. 7, the first housing section 100 of the projection apparatus is provided with a first projection opening 101, a second projection opening 102 and a third projection opening 103. The first projection opening 101 is provided with an inward projecting ring 104, on which a plurality of ball bearing grooves 106 with a built-in ball 105 are provided. The built-in ball 105 is movably matched with the holding ring 170, and the friction between the second rotary seat 17 and the inward projecting ring 104 can be reduced, such that the annular rotating seat can rotate more quietly, smoothly and efficiently on the first projection opening 101.

Preferably, the first rotary seat 16 is mounted below the inward projecting ring 104, and the second rotary seat 17 is mounted above the inward projecting ring 104. The first rotary seat 16 and the second rotary seat 17 are fixedly connected to form the annular groove 171 which is just clamping the inward projecting ring 104, such that the annular rotating seat does not disengage upwards or downwards.

Additionally, other structural parts not described in the second embodiment are the same as in the first embodiment of the present invention. The same part will not be described repeatedly.

FIGS. 9-12 show a third embodiment of the present invention. The third embodiment of the projection apparatus is distinguished from the first embodiment by the following characteristics.

The first projection component of the third embodiment comprises an annular lamp holder 18, and the first light source 1 is fixed on the annular lamp holder 18. The first light source 1 and the annular lamp holder 18 constitute the light source component, wherein the light source component is located between the transparent cover 4 and the reflective bowl 3.

Figure 9:
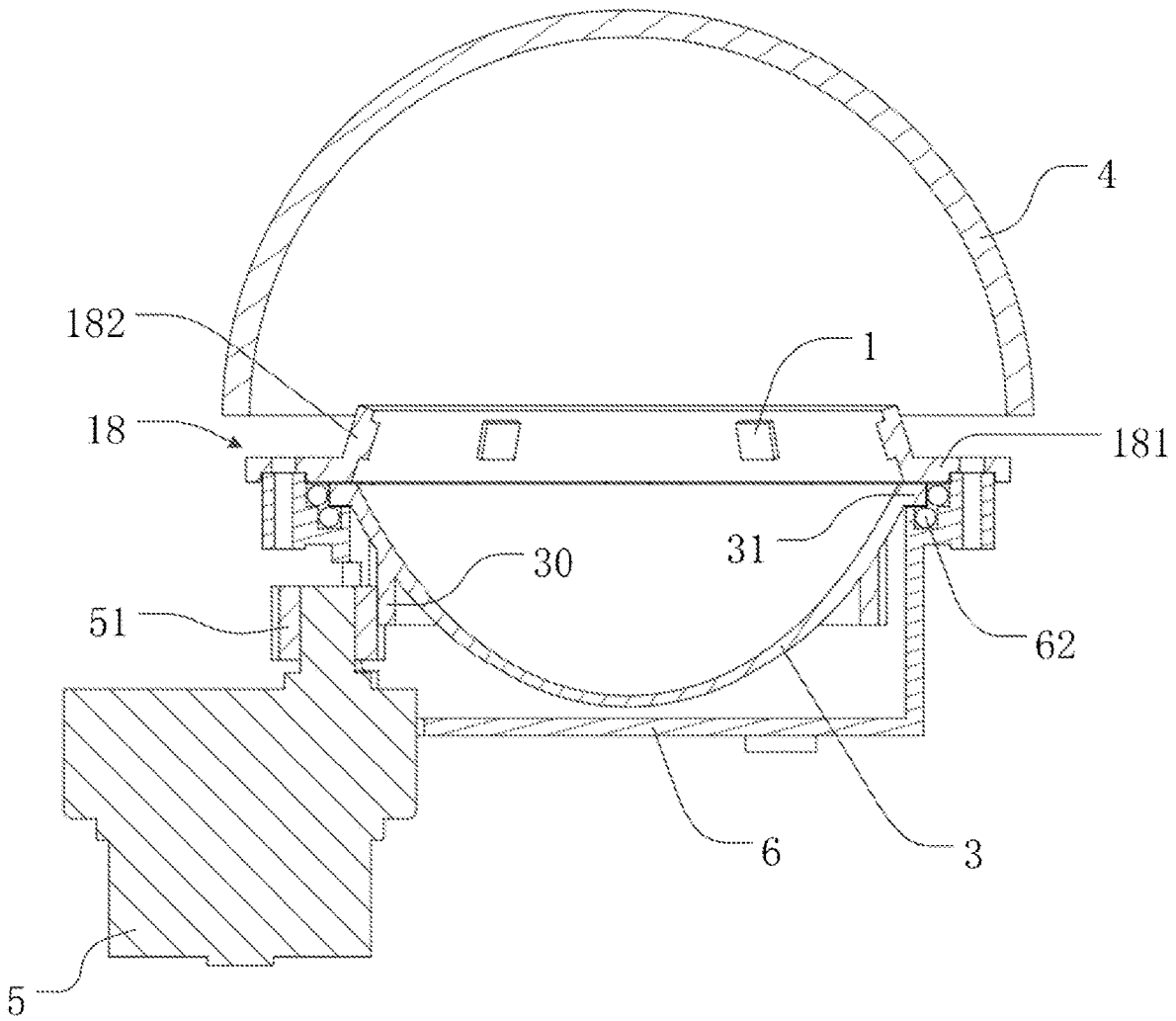
FIG. 9 is a cross-sectional view of the first projection component of the third embodiment of the present invention.
Figure 10:
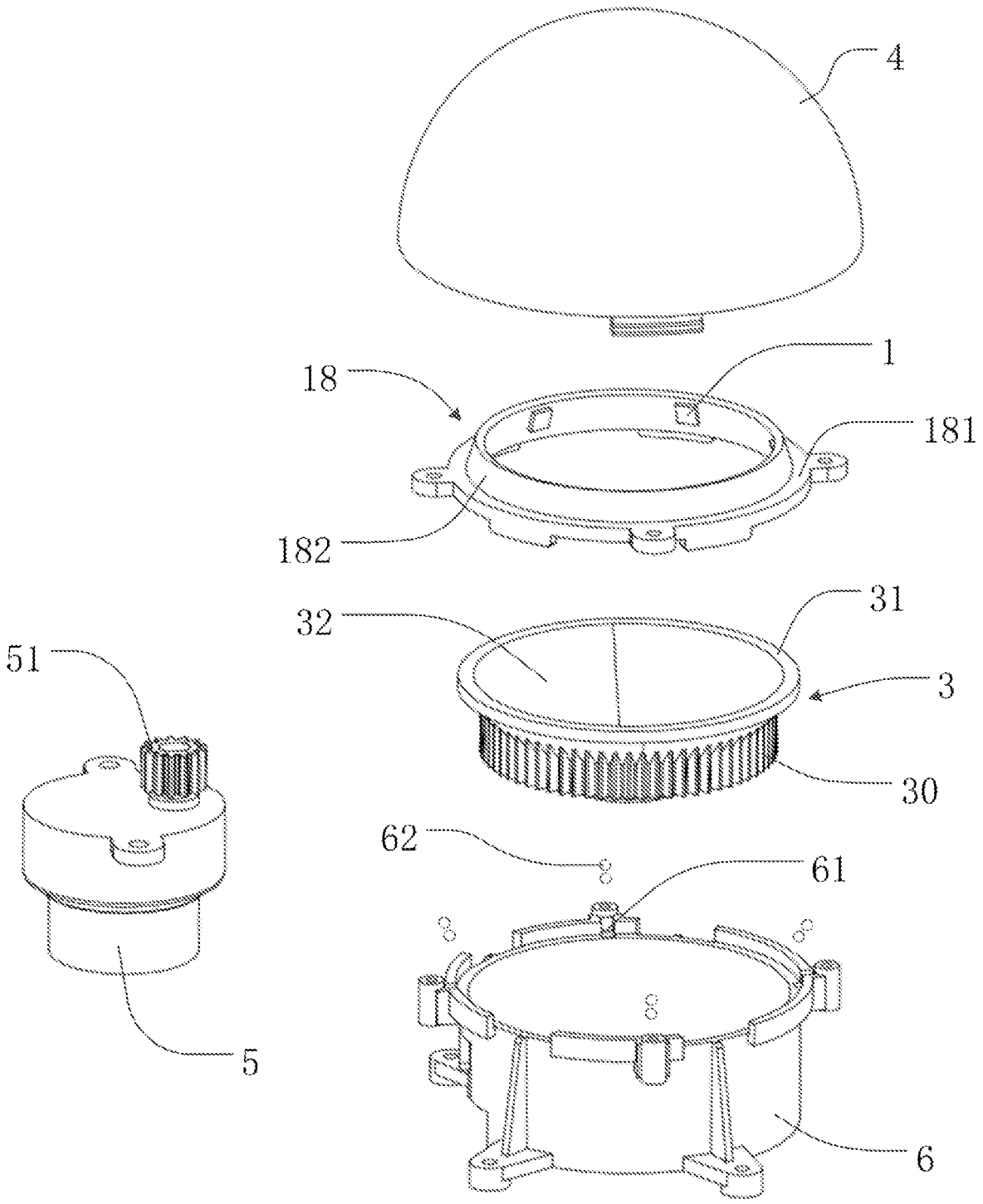
FIG. 10 is an exploded view of the first projection component of the third embodiment.
Figure 11:
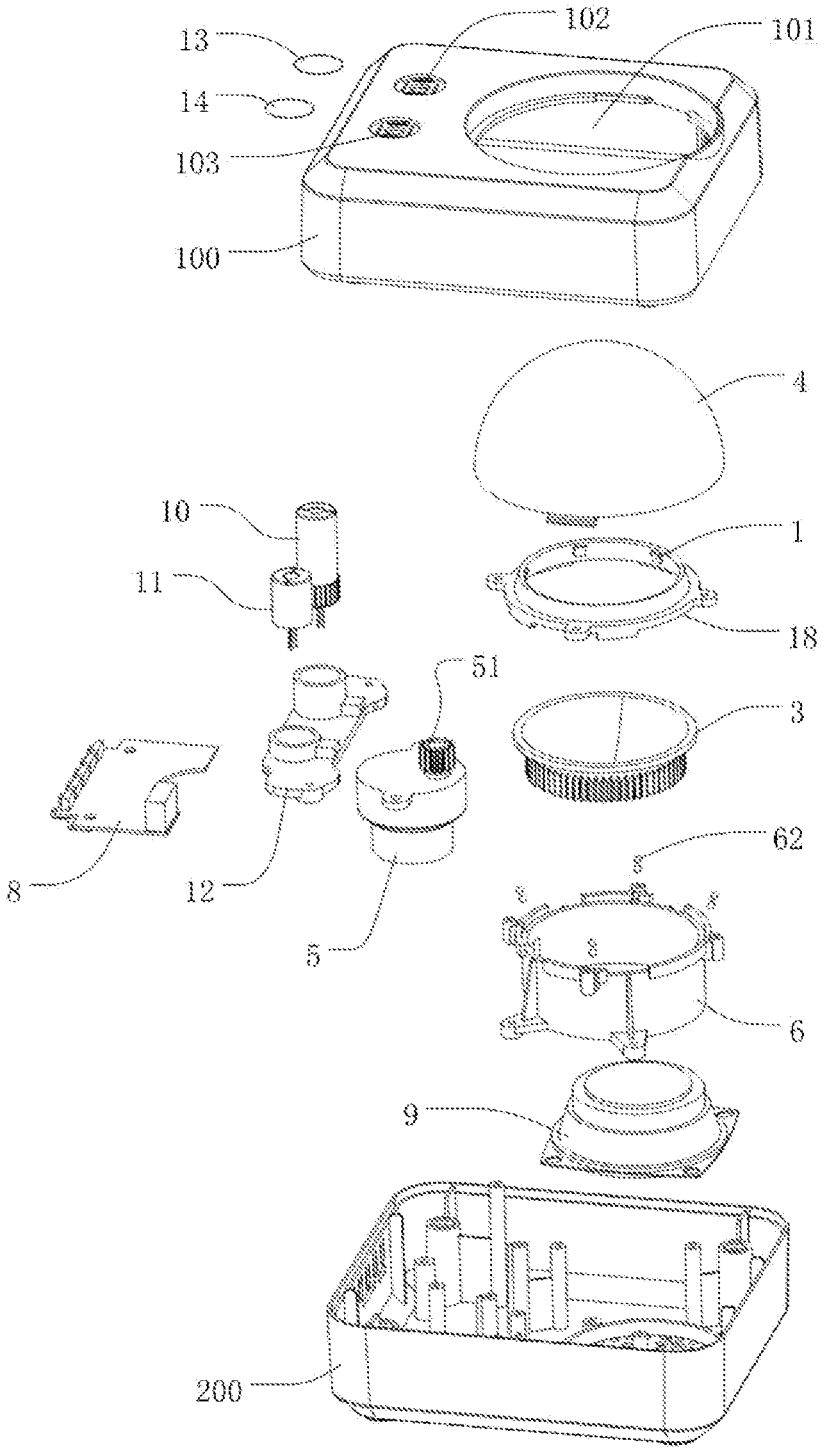
FIG. 11 is an exploded view of the overall structure of the projection apparatus of the third embodiment.
Figure 12:
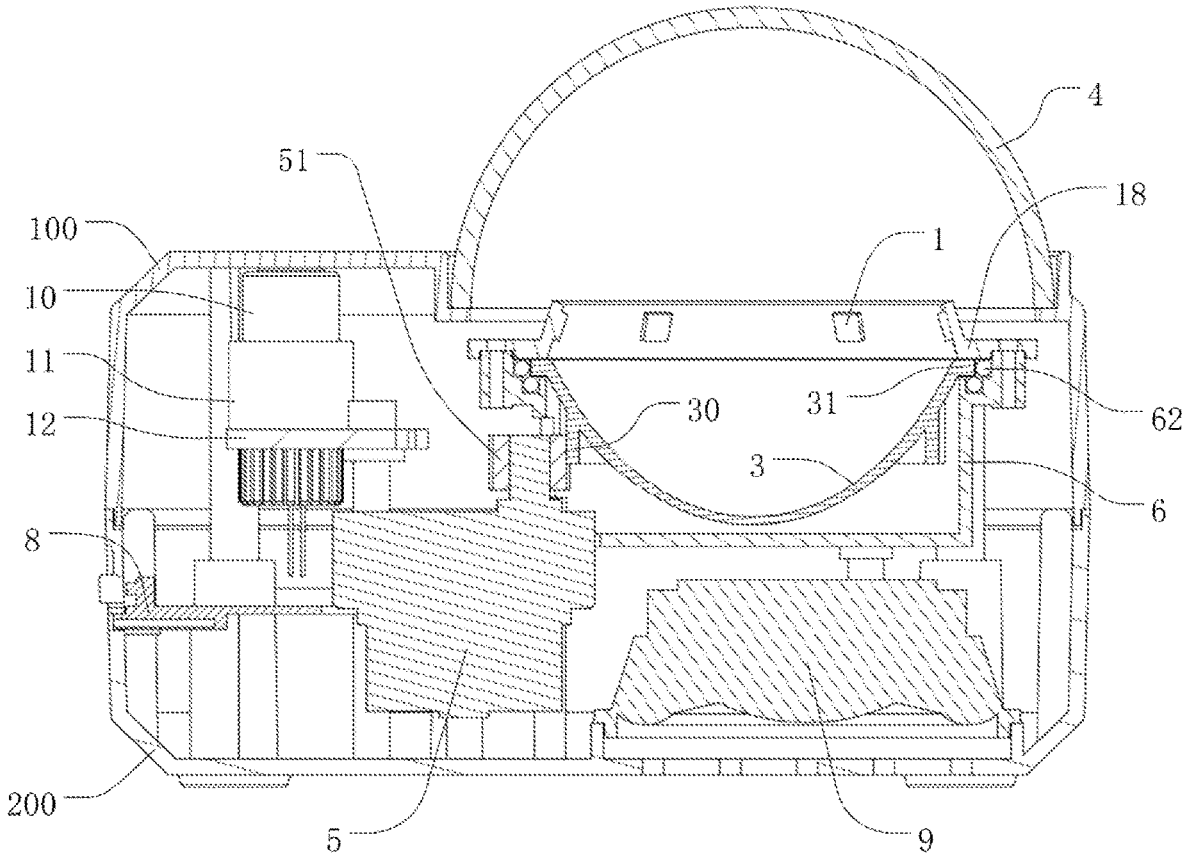
FIG. 12 is a schematic sectional view of the overall structure of the projection apparatus of the third embodiment.

Referring to FIGS. 9-10, the annular lamp holder 18 comprises a positioning portion 181 and an extension portion 182 formed from the positioning portion 181 towards the direction near the central axis of the annular lamp holder 18 and extending upward in an inclined direction. The first light source 1 is fixed on the inner surface of the extension portion 182, and the light emitted by the first light source 1 is illuminated on the reflective surface 32 of the reflective bowl 3.

Furthermore, the first projection component has neither the light conductor 2 nor the reflective bowl limit ring 7 in the first embodiment. The reflective bowl 3 has no through opening at the bottom thereof.

The annular lamp holder 18 is fixedly connected with the reflective bowl base seat 6. The reflective bowl base seat 6 is coupled with the positioning portion 181 of the annular lamp holder 18 to form a limit slot, and the reflective bowl 3 is provided with a limit portion 31 housed in the limit slot. The positioning portion 181 is used to prevent the reflective bowl 3 and the ball set 62 from being detached upward from the reflective bowl base seat 6.

Other structural parts not described in the third embodiment are the same as in the first embodiment of the present invention. The same part will not be described repeatedly.

Referring to FIGS. 13-16, the fourth embodiment of the present invention is shown. The fourth embodiment of the projection apparatus is different than the second embodiment (FIGS. 5-8) by the following characteristics.

The first projection component comprises an annular lamp holder 18, and the first light source 1 is fixed on the annular lamp holder 18. The first light source 1 and the annular lamp holder 18 constitute the light source component, wherein the light source component is located between the transparent cover 4 and the reflective bowl 3.

Figure 13:
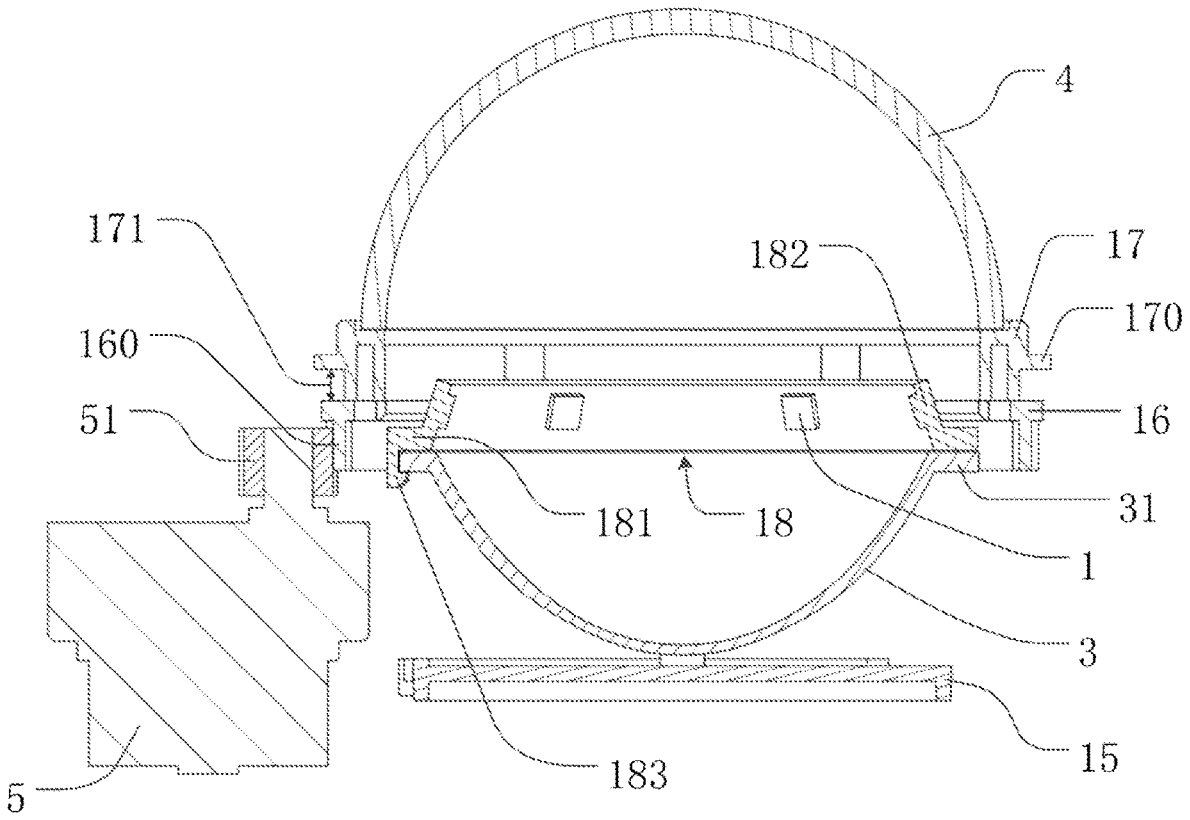
FIG. 13 is a cross-sectional view of the first projection component of the fourth embodiment of the present invention.
Figure 14:
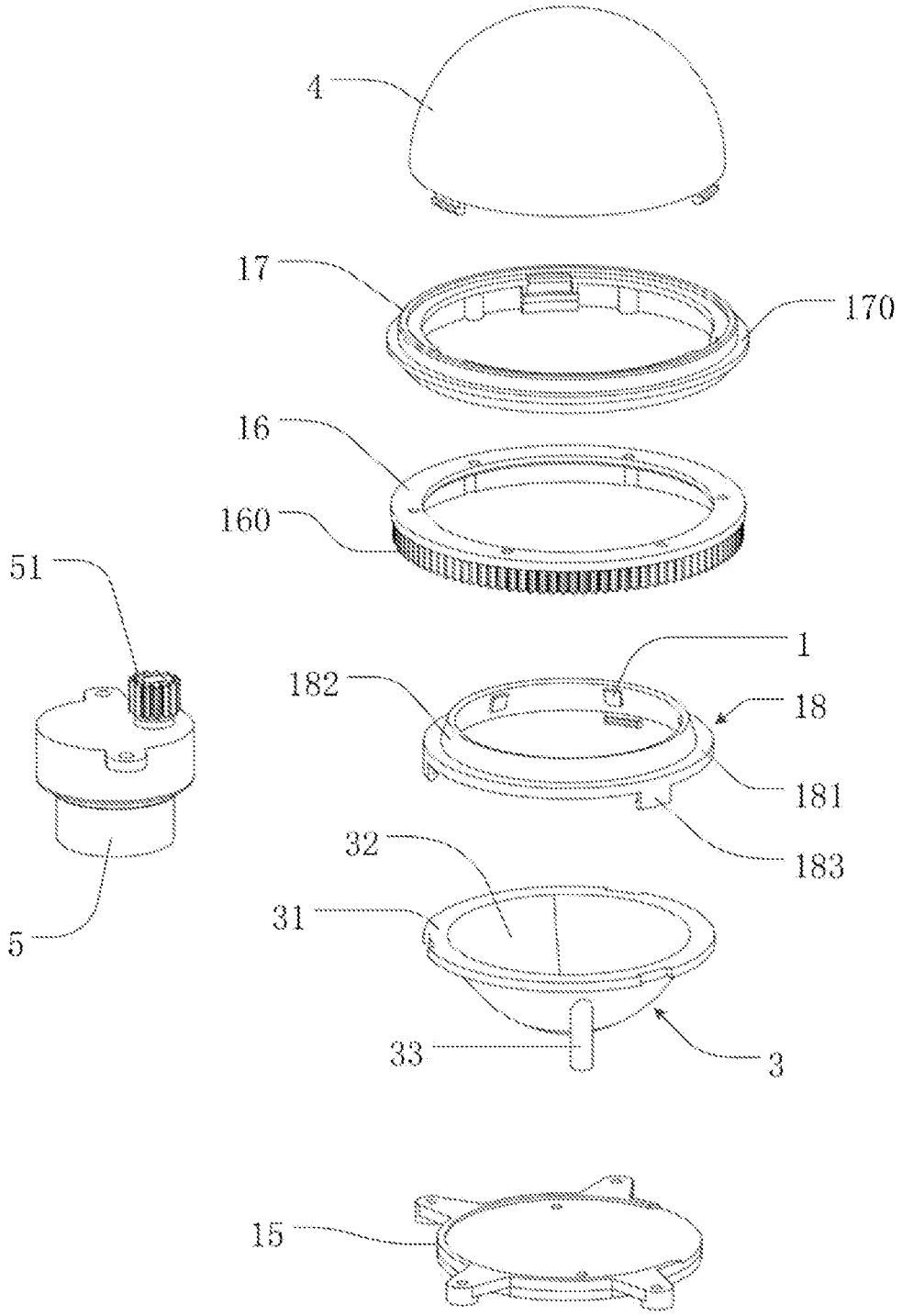
FIG. 14 is an exploded view of the first projection component of the fourth embodiment.
Figure 15:
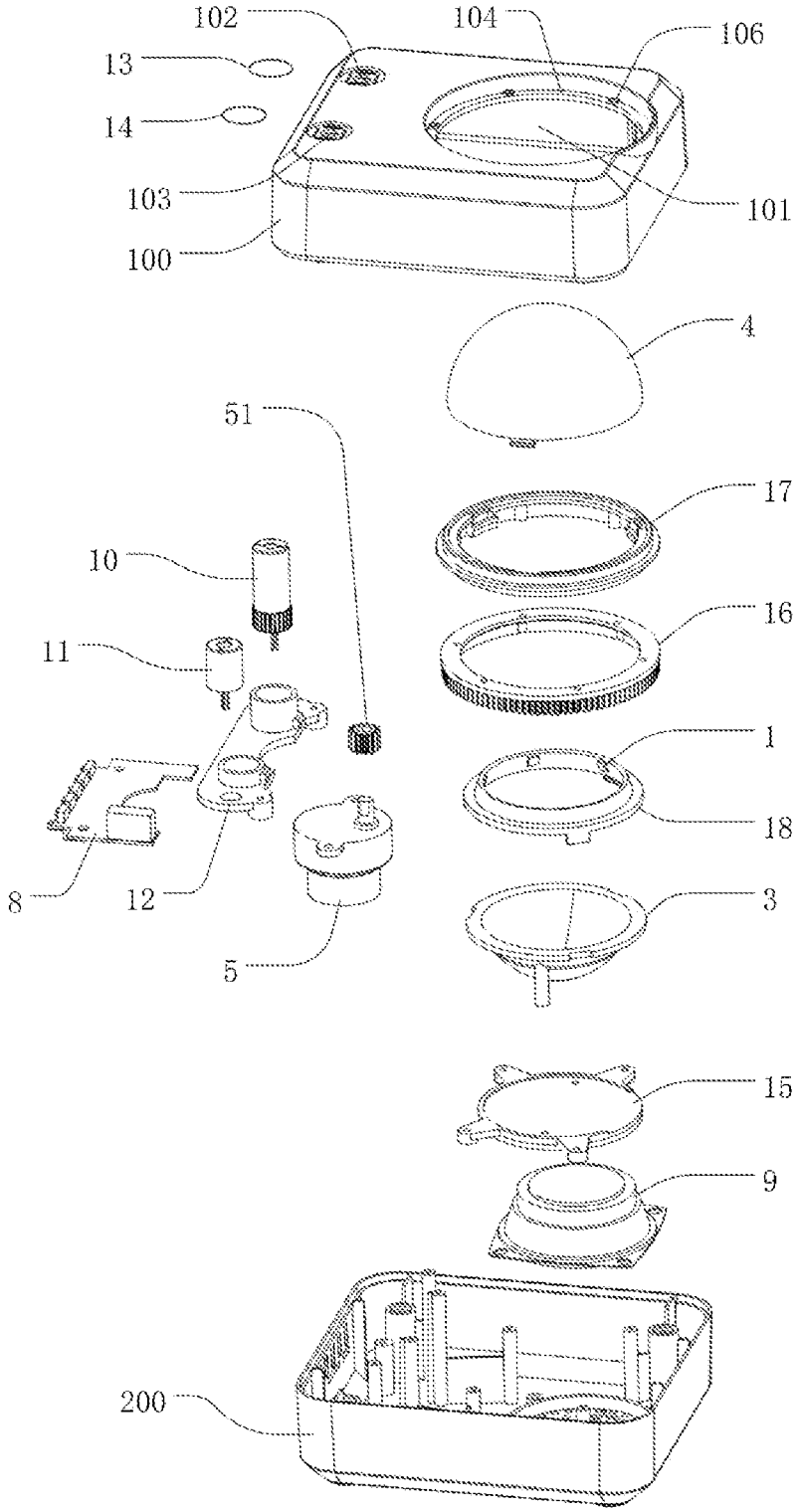
FIG. 15 is an exploded view of the overall structure of the projection apparatus of the fourth embodiment.
Figure 16:
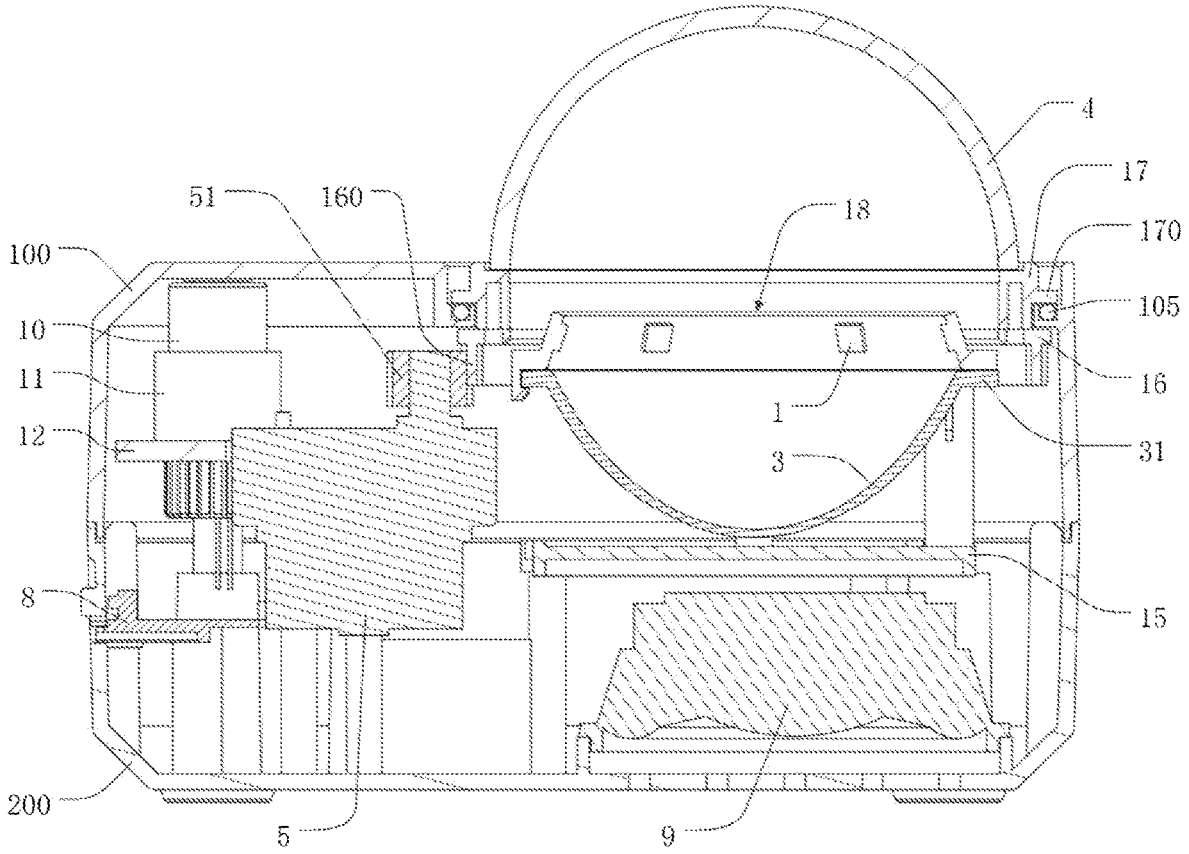
FIG. 16 is a schematic sectional view of the overall structure of the projection apparatus of the fourth embodiment.

Referring to FIGS. 13-14, the annular lamp holder 18 comprises a positioning portion 181 and an extension portion 182 formed from the positioning portion 181 towards the direction near the central axis of the annular lamp holder 18 and extending upward in an inclined direction. The first light source 1 is fixed on the inner surface of the extension portion 182, and the light emitted by the first light source 1 is illuminated on the reflective surface 32 of the reflective bowl 3.

The first projection component of the fourth embodiment is no longer provided with the light conductor 2. The reflective bowl 3 is directly connected with the first projection component fixed seat 15 through its fixed column 33.

Furthermore, the annular lamp holder 18 extends downward to form a plurality of buckle portions 183, and the buckle portion 183 is fastened with the limit portion 31 of the reflective bowl 3.

Other structural parts not described in the fourth embodiment are the same as in the second embodiment of the present invention. The same part will not be described repeatedly.

The aforementioned can be realized for those skilled in the art, and the modifications, equivalent replacements or variations made without departing from the concept of the present invention are supposed to be included in the protection scope of the present invention.

What is claimed is:

1. A projection apparatus comprising:

a housing with a projection opening, a light source component, a reflective bowl and a driving motor in the housing, and a transparent cover protruding upwardly out of the projection opening, wherein the reflective bowl is located between the transparent cover and the light source component, the reflective bowl comprises a through opening and a reflective surface, a light emitted by the light source component is illuminated on the reflective surface, and then the light passes through the transparent cover after being reflected;

wherein the driving motor drives the reflective bowl to rotate;

wherein the reflective surface is arranged as a diffusing reflective surface, and the diffusing reflective surface is formed by protrusions or indentations or a wrinkled or uneven surface to produce a cloud effect, and wherein the light source component comprises a light conductor sheathed outside the light source, the light conductor protrudes into the through opening of the reflective bowl.

2. The projection apparatus of claim 1, further comprising: a reflective bowl base seat fixed to the housing, and a reflective bowl limit ring, wherein the reflective bowl base seat is matched with the reflective bowl limit ring to form a limit slot, the limit slot is used to receive a limit portion of the reflective bowl.

3. The projection apparatus of claim 2, wherein the reflective bowl base seat comprises at least one ball groove and at least one ball set receiving in the ball groove, and the limit portion is movably matched with the at least one ball set.

4. The projection apparatus of claim 2, further comprising: an external ring gear coupled with the reflective bowl, wherein the external ring gear is engaged with a driving gear mounted on the driving motor.

5. The projection apparatus of claim 1, wherein the light source component comprises a non-coherent light source.

6. The projection apparatus of claim 5, wherein the light conductor comprises: a fixing portion, a light guide portion extending upward from the fixing portion, and a receiving cavity accommodating the non-coherent light source, wherein the light guide portion protrudes into the through opening of the reflective bowl, a top surface of the light guide portion is a downward concave inclined plane structure.

7. The projection apparatus of claim 1, wherein the transparent cover is a hemispherical structure, an inner surface of the transparent cover is a ray refracting surface made of a plurality of polygonal cut surfaces stitched together and an outer surface of the transparent cover is a smooth spherical surface.

8. A projection apparatus comprising:

a housing with a projection opening, a light source component, a reflective bowl and a driving motor in the housing, and a transparent cover protruding upwardly out of the projection opening, wherein the light source component is located between the transparent cover and the reflective bowl, the reflective bowl comprises a reflective surface, a light emitted by the light source component is illuminated on the reflective surface, and then the light passes through the transparent cover after being reflected, the driving motor drives the reflective bowl to rotate, wherein the reflective surface is arranged as a diffusing reflective surface, and the diffusing reflective surface is formed by protrusions or indentations or a wrinkled or uneven surface to produce a cloud effect, and wherein the light source component comprises a light conductor sheathed outside the light source, the light conductor protrudes into the through opening of the reflective bowl.

9. The projection apparatus of claim 8, wherein the light source component further comprises an annular lamp holder and at least one non-coherent light source fixed on the annular lamp holder, and the annular lamp holder includes a positioning portion and an extension portion formed from the positioning portion, the non-coherent light source is fixed on the inner surface of the extension portion, and a light emitted by the non-coherent light source is illuminated on the reflective surface.

10. The projection apparatus of claim 9, further comprising: a reflective bowl base seat fixed to the housing, the reflective bowl base seat is matched with the positioning portion to form a limit slot, and the reflective bowl includes a limit portion housed in the limit slot.

11. The projection apparatus of claim 10, wherein the reflective bowl seat includes at least one ball groove and at least one ball receiving in the ball groove, and the limit portion is movably matched with the at least one ball.

12. The projection apparatus of claim 8, wherein the reflective bowl includes an external ring gear engaged with a driving gear mounted on the driving motor.

* * * * *